US005533668A

United States Patent [19]

Erikson

[11] Patent Number: 5,533,668

[45] Date of Patent: Jul. 9, 1996

[54] REMOTELY ACTIVATED OPPOSING/AIDING AIR FLOW CONTROL REGISTER

[75] Inventor: Evans W. Erikson, Belvidere, Ill.

[73] Assignee: Hampton Electronics, Rockford, Ill.

[21] Appl. No.: 432,609

[22] Filed: May 1, 1995

Related U.S. Application Data

[63] Continuation-in-part of Ser. No. 269,103, Jun. 30, 1994, Pat. No. 5,413,278.

[51] Int. Cl.[6] ..... F24F 11/053

[52] U.S. Cl. ..... 236/49.3; 137/802; 236/51; 415/910; 417/326; 454/256; 454/338

[58] Field of Search ..... 137/802; 236/49.3, 236/51; 415/910; 417/315, 326; 454/256, 258, 292, 297, 338

[56] References Cited

U.S. PATENT DOCUMENTS

| | | | |
|---|---|---|---|
| 3,320,406 | 5/1967 | Wainwright | 417/326 X |
| 3,776,279 | 12/1973 | O'Connor, Jr. | 137/802 |
| 4,479,604 | 10/1984 | Didner | 236/49 |
| 4,530,395 | 7/1985 | Parker et al. | 165/16 |
| 4,969,508 | 11/1990 | Tate et al. | 165/22 |
| 5,271,558 | 12/1993 | Hampton | 236/49.3 |
| 5,404,934 | 4/1995 | Carlson et al. | 236/49.3 X |

*Primary Examiner*—Harold Joyce
*Attorney, Agent, or Firm*—Harold A. Williamson

[57] ABSTRACT

A bi-directional airflow controllable system for controlling flow of air through an air circulating system to at least one zone an air temperature of which is to be controlled is coupled to an airflow duct to aid or oppose airflow throughout the duct and the system to the zone. The bi-directional airflow controllable system includes a fan positioned to interact with air moving through the system and the duct. The fan is coupled to a motor to be energized to drive the fan in a forward or reverse direction. The fan when driven by the energized motor in a forward direction creates air pressure from the fan to oppose the flow of air from the airflow duct. The fan when driven by the energized motor in a reverse direction aids the flow of air from the airflow duct. A bi-directional airflow control unit is electrically coupled to the motor. The bi-directional airflow control unit is responsive to a desired temperature in the zone to cause the motor to be energized in a forward direction to oppose flow through the system until the desired zone temperature is attained. The control unit is additionally responsive to the desired temperature in the zone to cause the motor to be energized in a reverse direction to aid the airflow through the system until the desired zone temperature is attained.

3 Claims, 6 Drawing Sheets

| LOGIC UNIT | | |
|---|---|---|
| INPUT A | HEATING MODE INPUT HI | COOLING MODE INPUT LO |
| INPUT B | $T_Z > T_{ZSP}$ (LO) | $T_Z \leq T_{ZSP}$ (HI) | $T_Z > T_{ZSP}$ (LO) | $T_Z \leq T_{ZSP}$ (HI) |
| | SHORT | OPEN | OPEN | SHORT |

OPEN = DC FAN MOTOR FREEWHEELING

SHORT = DC FAN MOTOR POWERED AND FAN MOTOR ROTATION REVERSED FROM FREEWHEELING 250
200
TRANSMITTER
225
227
226
219
218
OUTPUT PWM GENERATOR
217
223
215
216
222
220
AIRFLOW DELAY AND CONFIRM
224
214
212
OUTPUT CONTROL SECTION
CONTROL CYCLE TIMER
213
221
277
278
275
AIRFLOW SIGNAL(RPM)
DISCHARGE AIR TEMPERATURE
276
208
210
211
209
DECISION TEMPERATURE vs SETPOINT
207
273
274
SIGNAL DECODE
272
271
205
206
SIGNAL(PWM) INPUT
270
258
POWER SUPPLY INPUT
201
203
ZONE SETPOINT
204
ROOM/ZONE SENSOR
202
269
266
RECEIVER
268
257
TO/FROM FIG.9
WIRELESS AIRFLOW CONTROL THERMOSTAT

REMOTELY ACTIVATED OPPOSING/AIDING AIR FLOW CONTROL REGISTER

This application is a continuation-in-part of application Ser. No. 08/269,103 filed Jun. 30, 1994 U.S. Pat. No. 5,413,278.

FIELD OF INVENTION

A control system and airflow control register for use in a single or multi zone HVAC unit where air is delivered into one or more zones through an air delivery register(s).

BACKGROUND OF THE INVENTION

It has been long recognized in large building structures that the cost of heating or cooling the structure significantly impacts the bottom line of the large business enterprises that occupy these structures. It is also known that for small business entities such as a clinic, office or retail structure total energy costs related to lighting, heating or cooling breaks down this way: 40% is for heating and cooling, 40% for lighting and the balance for business related equipment. The U.S. Department of Energy estimates that a substantial portion of the heating, cooling and lighting cost is wasted as a result of the lack of an economical, effective system to control it.

In the design stage of large business structures elaborate lighting, heating and cooling systems are built into the structures at the outset with an expectation that significant energy savings translated into dollars will be realized for the business occupying these structures. In the smaller business building market almost all heating and ventilation systems employ a single zone HVAC unit to supply conditioned, heated or cool air to more than one distinct zone or room. Each room or zone may have different comfort requirements due to occupancy differences, individual preferences, exterior load differences, and the different zones may be at different levels, thereby creating different heating or cooling requirements. This type of system is referred to as a single zone HVAC unit because it is normally controlled from one centrally located ON/OFF thermostat controller. In a building which may have more than one zone and whose zones have different heating, and cooling requirements, it becomes difficult to chose a good representative location for the thermostat controller.

In the technical literature which embrace patented technologies there have been a number of note worthy attempts to provide systems that address the problems of controlling the different needs of more than one zone which is provided heating and cooling from a single zone HVAC.

The invention of the Ser. No. 269,103 application is directed to a method and apparatus for controlling airflow in a given direction in an air circulating system in which the method comprises the steps of:

(a) placing a motor driven fan in the air circulating system in such a manner that the fan, when driven by the motor, creates pressure in a direction opposing the given direction of airflow, and (b) activating the motor to drive the fan to cause the airflow moving in said given direction to be diminished because of said opposing pressure.

The apparatus embodying the invention is directed to an airflow controllable register for controlling a flow of air through the register from a register airflow supply duct in response to an externally provided control signal that commands differing airflow rates thought the register. More specifically, the airflow controllable register includes a register flow control unit that includes a rotary mounted fan positioned within the register airflow supply duct. The fan is coupled to a motor. The fan when driven by the energized motor creates air pressure from the fan to reduce to flow of air from the supply duct. All of the circuit details set forth in the specification and drawings of the '103 patent application are included in this continuation-in-part application.

As the description of the improvement described in this specification unfolds it will be recognized that in addition to opposing airflow through a register, the invention also provides for an automatic boost of airflow through the system to enhance temperature control in any one of a number of zones.

Another recently issued U.S. Patent is that of Brian Hampton U.S. Pat. No. 5,271,558 (558) titled Remotely Controlled Electrically Activated Airflow Control Register. The '558 patent is assigned to the same assignee as that of the instant application and the '103 application.

Many of the circuit details set forth in the subject applications were originally set forth and fully described in the '558 patent. No claim of novelty is put forward with respect to these circuit details per se in this application.

The invention of the '558 Patent is directed to a control system for an air delivery system having a supply duct through which air is delivered into at least one independently controlled zone through an air delivery register. A wireless airflow control unit is provided to transmit a wireless airflow control signal output to an electrically powered and electrically self-sufficient flow control unit located in the air delivery system. The electrically powered and electrically self-sufficient flow control unit controls the flow of the air in response to receiving the wireless airflow control signal output. The electrically powered and electrically self-sufficient flow control unit includes a generator to provide electrical power in response to flow of air from the supply duct. The generated electrical power is delivered to the flow control unit to thereby maintain the flow control unit electrically self-sufficient and free from the need of any outside electrical power source. The generator includes a rotary mounted turbine positioned within a supply duct of the air delivery register. The turbine is coupled to the generator to drive the generator in response to conditioned airflow against blades of the turbine. The generator provides electric power to the flow control unit to maintain the flow control unit electrically self-sufficient. The air delivery system is a normally single zone HVAC unit. The flow control unit includes a HVAC temperature detection unit that determines when the HVAC unit is delivering heated, cooled conditioned air or recirculated ambient air. The HVAC temperature detection unit has an output signal to a logic unit. The logic unit is also responsive to a wireless airflow control signal. The flow control unit additionally includes a turbine/generator load control unit coupled electrically to receive an output signal for the logic unit. The logic unit output signal controls a loading of the generator so that the air turbine is braked thereby reducing flow of conditioned air past the air turbine and into a zone.

The invention of the '558 patent has proved to be popular especially where there is present a high level of concern for maximizing electrical energy savings. The invention of the '103 application of which this application is a continuation-in-part has proved equally popular in environments where low voltage D.C. power may be employed to power the electronics mounted in the register and to power a motor to drive a turbine as a fan in such a manner as to provide air pressure that opposes the normal airflow in the air delivery system, thereby controlling airflow through a register in a zone. The invention in the subject application also provides for an automatic boost of airflow through the system to enhance temperature control in anyone of a number of zones.

Another such U.S. patent is that of Tate et al U.S. Pat. No. 4,969,508 ('508) in which the temperatures in the room(s) are controlled by means of a wireless portable remote control unit which may be hand held by the room occupant. The wireless remote control unit transmits information to a remote receiver in the ceiling of the room, which in turn provides signals to a main control unit physically coupled to external environmental control units such as the air conditioning system, heater, damper motors and the like.

The wireless remote control unit of the '508 patent in addition to being able to select heating and cooling modes may also operate in an energy saving mode. To this end a light sensing circuit is provided for overriding preselected conditions when the lights in the room are off. An infra red transmitter is employed for transmitting data to an infra red receiving unit on the ceiling when the lights are on.

The subject invention distinguishes over the '508 patent in that the '508 patent requires wiring of an entire duct work system to provide power to many power driven dampers, whereas the subject invention simply calls for an A.C. or D.C. power converter in each room or zone to be controlled. The subject invention additionally provides a low D.C. voltage source at the register to power the electronics associated with the control of the register.

Another approach to providing multiple heating/cooling zones which employs a single zone HVAC unit is shown and described in the Parker et al U.S. Pat. No. 4,530,395 ('395). The Parker et al arrangement provides zone control in plural zones in which each zone includes a control thermostat that is interfaced with a monitoring system so that each zone thermostat controls the HVAC unit as well as a damper unit for the particular zone. More specifically the system is comprised of two or more computerized thermostats which control both the HVAC unit through the monitoring control and the air distribution system of each zone through the damper for each zoned. The thermostats also operate under control of signals received from the monitor.

The '395 patent is classic in its complex solution to the very simple concern of independently and automatically controlling the temperature in one of many zones simultaneously. The '395 patent like the '508 just reviewed requires electrically powered damper motors that become part of a complex wiring system.

The subject invention requires no such complex wiring and may be readily installed in an existing HVAC system by simply removing a selected air distribution register and placing within an exposed air supply duct the apparatus of the instant invention, which is then electrically connected to an existing electrical system by means of an A.C. to D.C. converter.

A wireless thermostat control device hung on a wall of a zone completes the installation of the subject invention in almost no time at all with little labor cost.

In yet another multiple zone system having a single control HVAC unit Robert S. Didier in his U.S. Pat. No. 4,479,604 ('604) shows and describes a controller for a control plant feeding a plurality of adjustable zone regulators which bring their respective zones to corresponding target temperatures. The controller has a plurality of temperature sensors and a plurality of zone actuators. The temperature sensors distributed one to a zone, each produce a zone signal signifying zone temperature. The zone actuators each have a zone control terminal. Each actuator can, in response to a signal at its zone control terminal, operate to adjust a corresponding one of the zone regulators. The controller also has a control means coupled to each of the temperature sensors and to the zone control terminal of each zone actuator for starting the central plant. The central plant is started in response to a predetermined function of zone temperature errors (with respect to their respective target temperatures) exceeding a given limit. The system considers the temperature error in each of the zones. When the sum of the errors exceeds a given number, the furnace or air conditioner can be started.

In addition to the distinctions offered in respect of the '508 and '395 patents the subject invention is amazingly simple in design and may be powered by a D.C. voltage power source at a zone to be controlled thereby obviating the need for a complex wiring system inherent in the '604 patent.

SUMMARY OF THE INVENTION

The invention is directed to a method and apparatus for bi-directional airflow control in an air system that provides airflow in a given direction in which the method comprises the steps of:

a. placing a motor driven fan in the air circulating system in such a manner that the fan when driven by the motor in one direction creates pressure in a direction opposing the given direction of airflow. The fan when driven by the motor in an opposite direction reduces pressure in a direction which aids airflow in the given direction of airflow, b. activating the motor to drive the fan in the one direction to cause the airflow moving in the given direction to be diminished because of the opposing pressure, and c. activating the motor to drive the fan in the opposite direction to cause the airflow moving in the given direction to be aided because of the reduced pressure.

More specifically, the invention is directed to a bi-directional airflow controllable system for controlling flow of air through an air circulating system to at least one zone an air temperature of which is to be controlled. The bi-direction airflow system is coupled to an airflow duct to aid or oppose airflow throughout the duct and the system to the zone. The bi-directional airflow controllable system includes a fan positioned to interact with air moving through the system and the duct. The fan is coupled to a motor to be energized to drive the fan in a forward or reverse direction. The fan when driven by the energized motor in a forward direction creates air pressure from the fan to oppose the flow of air from the airflow duct. The fan when driven by the energized motor in a reverse direction aids the flow of air from the airflow duct.

A bi-directional airflow control unit is electrically coupled to the motor.

The bi-directional airflow control unit is responsive to a desired temperature in the zone to cause the motor to be energized in a forward direction to oppose flow through the system until the desired zone temperature is attained. The control unit is additionally responsive to the desired temperature in the zone to cause the motor to be energized in a reverse direction to aid the airflow through the system until the desired zone temperature is attained.

It is therefor a primary object of the invention to provide a method and apparatus for bi-directional airflow control in an air system that provides airflow in a given direction.

It is also a major object of the invention to provide an electrically controlled automatically adjustable airflow register.

Another object of the invention is to provide an air circulating system that controls airflow in a given direction in the system by introducing an opposing pressure to thereby diminished airflow past a point in the system where the opposing pressure has been introduced.

A further object of the invention is to provide an automatically adjustable airflow register that when added to an existing system has minimal affect on airflow when a free flow of air through the register is desired.

In the attainment of the foregoing objects the invention contemplates as falling within the purview of the claims appended to the specification a control system for an air delivery system which is normally a single zone HVAC unit. The air delivery system includes a single air supply duct through which conditioned air is delivered. The control system assumes that there is at least one independently controlled zone or room which receives air delivered through an air delivery register.

The control system includes two basic components one of which is an airflow thermostat control that communicates with and controls an electrically powered register flow control unit which controls the flow of conditioned air through the air delivery.

A typical system involves a plurality of zones, each zone having one or more delivery registers, each of which is coupled to the single air supply duct noted earlier.

The airflow control thermostat delivers an airflow control signal which as characterized as a continuously transmitted control signal for as long as a desired setpoint temperature for an associated zone is either above or below an ambient temperature in the associated zone.

The electrically powered register flow control unit controls the flow of air through the register in response to receiving the flow control signal. This just noted register flow control unit, in one embodiment of the invention, includes a motor driven fan within a register supply duct associated with an air delivery register. The motor driven fan of this embodiment is positioned in such a manner that, when energized, the fan rotates so as to provide an opposing air pressure to that which normally passes through the register. This opposing pressure diminishes the amount of airflow passing the fan thereby controlling the airflow through the register into a zone.

In a highly preferred embodiment of the invention which this continuation-in-part application covers the motor driven fan arrangement may be driven in one direction to provide opposing pressure to a given direction of airflow or in a reverse direction to aid flow in the given direction of airflow.

In systems where both heating and cooling are provided the register flow control unit also includes an HVAC temperature detector to determine whether the HVAC unit is delivering heated or cooled air. The HVAC temperature detector has an output signal to a logic circuit representative of either heating or cooling by the HVAC.

In the one embodiment of this continuation-in-part application the register flow control unit includes an airflow control signal detection circuit electrically coupled to a decoding circuit to provide an output signal from the decoding circuit to the logic circuit representative of whether an ambient temperature in a zone associated with the register flow control unit is greater than a desired setpoint temperature of the zone or whether the decoding circuit output is representative of the fact that the ambient temperature in the zone is less than or equal to the desired setpoint temperature in the zone.

Finally the logic circuit provides the output signal which controls the energization of the motor driven fan whenever a preselected combination of output signals from the HVAC temperature detection circuit and decoding circuit calls for an increase or decrease in airflow through the air delivery register.

In less technical term and by way of summary, assume that it is summer, during the cooling season and the air conditioning has just come on in an office building. In the cooling operation, cooled airflows down the air supply duct through the flow control unit and out an air delivery register. As the cool airflows down the air supply duct through the register flow control unit the flow of air turns the fan in a freewheeling manner such that little restriction to airflow through the register is present. This operation will continue until the flow control thermostat has determined that the desired temperature level has been reached. Now that the room or zone is cool enough and further amounts of cool air are not only unnecessary, but waste costly energy, the system responds by having the flow control thermostat signal the electronic controls in the register flow control unit to restrict further airflow by energizing the motor driven fan to provide an opposing air pressure to normal system flow at the register.

From the foregoing it will be readily appreciated that the opposing air pressure will result in a significantly reduced airflow from the register flow control unit through the air delivery register.

The increase in back pressure at a single register in a multiple register system will cause an increase in flow from other registers in the system. While the increase in back pressure accelerates the cooling in the other offices or zones, there may be offices with southern exposures that become much hotter than is comfortable for the office occupants. In this type of situation there is a need to boost the flow of cool conditioned air to these office(s). The boost in cool air is brought about by reversing the motor/fan rotational direction to provide an aiding airflow condition to the rooms. As each office/room reaches a comfort setpoint selected by the office user, the register airflow control unit will reduce airflow to that office.

The result of restricting or boosting airflow to each office or room in this manner provides not only a substantial increase in comfort, but the achievement of comfort levels more quickly than the standard ON/OFF method so that the air conditioning unit can be shut down sooner thereby saving energy cost.

Use of the invention also reduces the flow from the supply system which reduces the energy required to drive the supply system.

BRIEF DESCRIPTION OF THE DRAWINGS

The description set forth above, as well as other objects, features and advantages of the present invention, will be more fully appreciated by referring to the detailed description and drawings that follow. The description is of the presently preferred but, nonetheless, illustrative embodiments in accordance with the present invention, when taken in conjunction with the accompanying drawings wherein;

FIGS. 8 and 9 are taken together.

DETAILED DESCRIPTION OF THE PREFERRED EMBODIMENTS

Figure 1:
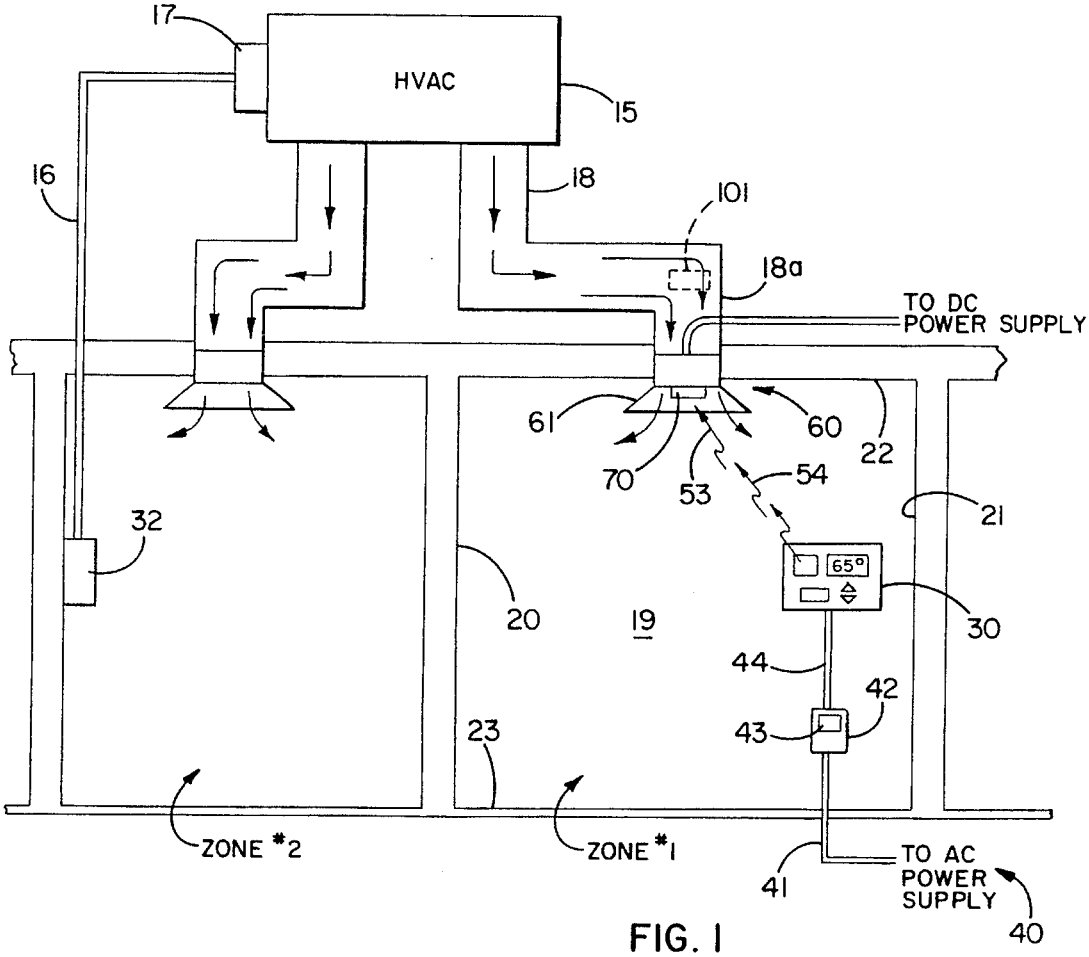
FIG. 1 is a schematic layout of an office complex with a number of zones to be heated or cooled by employing the invention described herein.

Reference is now made to FIG. 1 which illustrates schematically an office complex in a building not shown. The office complex includes two (2) zones to be provided with hot or cooled air from an HVAC (heating, ventilating, air conditioning) unit 15. Zone #1 is defined by a pair of side walls, 20 and 21, a ceiling 22 and floor 23. A fourth side wall is present, but not shown. Accordingly zone #1 is one of many office/rooms in the office complex. Zone #2 is similar in overall configuration as zone #1.

The zone #1 includes a wall mounted wireless airflow control thermostat (30,31) to be described more fully hereinafter with respect to FIG. 6. It is to be understood that while the preferred embodiment of the invention shows the use of a wireless infra red (IR) controllable thermostat. The invention is equally useful with a wide range of different types of thermostats of a wireless of hard wired nature. Zone #2 is provided with a conventional ON/OFF thermostat 32 electrically coupled via an electrical line 16 to HVAC controller 17. Electrical power is provided to the wireless airflow control thermostat 30 from an AC power supply 40 via electrical line 41. Line 41 leads to a wall outlet 42 which has schematically shown a zone manager power supply 43 to provide electrical power via line 44 to wireless airflow control thermostat 30. Wireless airflow control signals 53, 54 depicted as jagged separated lines are shown directed toward an air diffuser portion 61 of an air delivery register 60. The HVAC 15 delivers conditioned air to zone #1 via a single duct 18 and a branch air supply duct 18*a*. Positioned in the branch air supply duct 18*a*, as shown in FIG. 2 and FIG. 3 are the electrically powered register flow control unit 70 of the instant invention.

Figure 2:
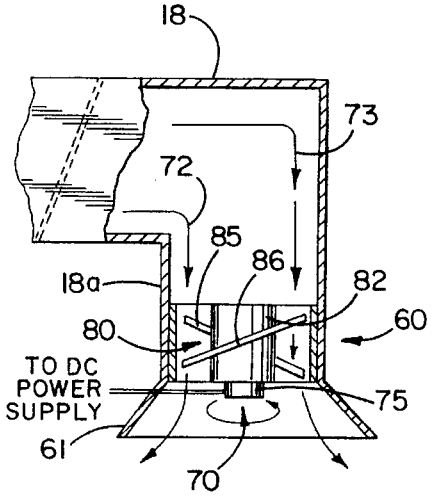
FIG. 2 shows in cross section a portion of the airflow control system that embodies one form of the invention where the invention is depicted in a free wheeling mode.
Figure 3:
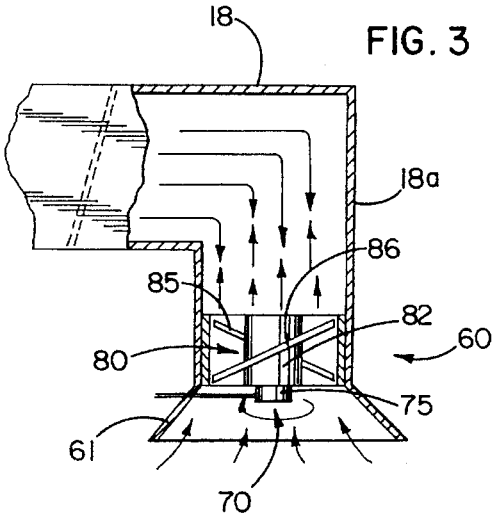
FIG. 3 shows in cress section a portion of the airflow control system that embodies the invention where the invention is depicted in an airflow opposing mode.

In order to appreciate how the register flow control unit 70 operates, one of the units 70 is shown in FIG. 2 in partial section in a free wheeling mode and in partial section in FIG. 3 in an air pressure opposing mode.

Turning now to FIG. 2 there is shown an end portion of the single air supply duct 18*a* secured thereto by means not shown. An air diffuser portion 61 which forms a major part of the air diffuser register 60 in secured to the branch air supply duct 18*a* by conventional means not shown. An electrically powered register flow control unit 70 is shown in position to demonstrate the manner in which airflow, indicated by airflow arrows 72 and 73,pass by the register flow control unit when a fan 80 is in a freewheeling mode.

In FIG. 3 an arrow 70 points towards the electrically powered register flow control unit. The register flow control unit is made up of two major elements, the first of which is an electronic control box 75 that is electrically coupled via leads not shown to an input of a DC motor not shown but mounted within a rotatable supported air turbine hub 82. The hub 82 also forms the rotor of the D.C. motor. The operation of the electronic circuitry in the electronic control box 75 which is secured to a structural member not shown of the air delivery register 60 will be described when the operation of FIG. 4 is reviewed.

Figures 4, 5:
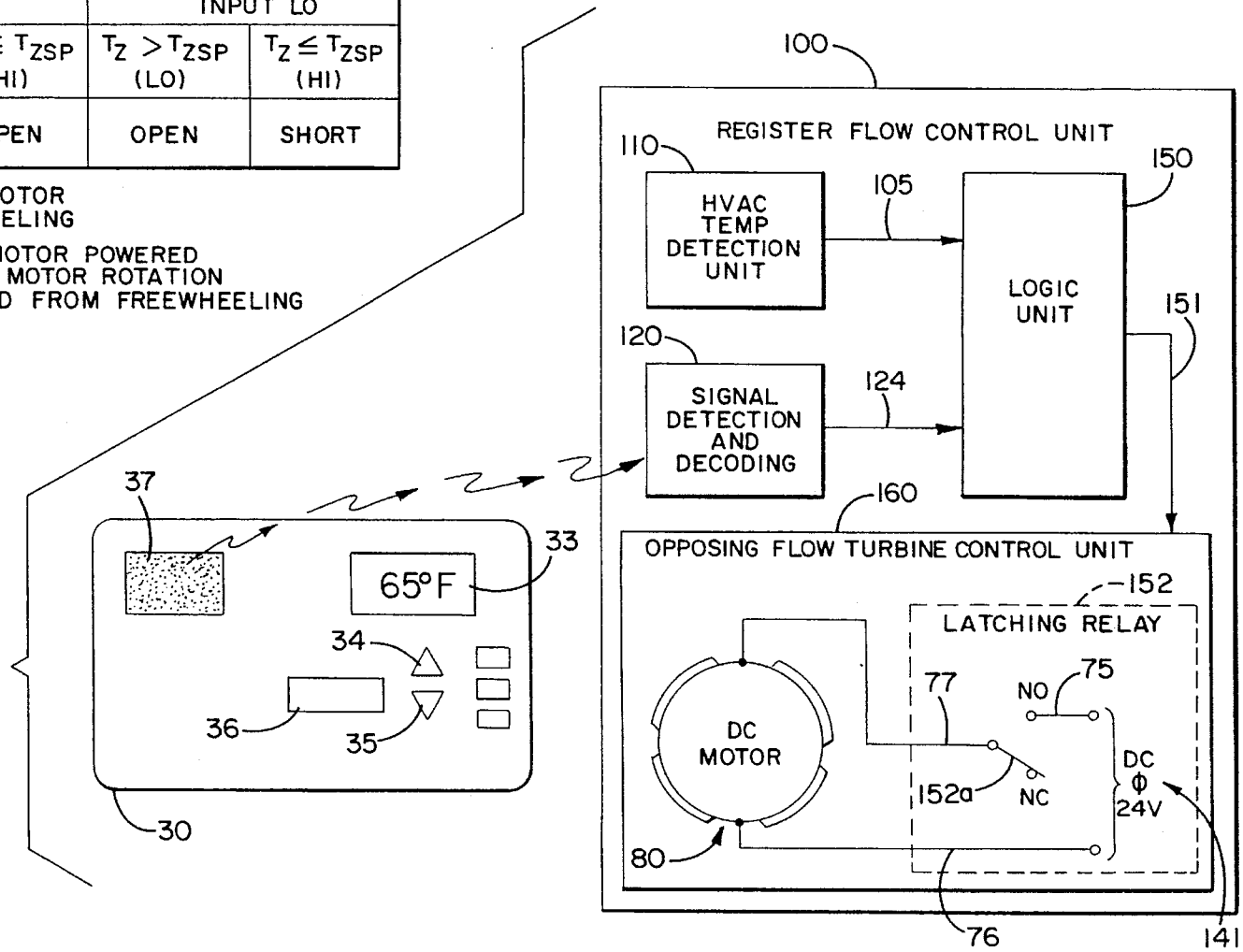
FIG. 4 is a block diagram illustration of an air control system, that embodies one form of the invention.
FIG. 5 is a logic unit block diagram.

When FIGS. 3,4, and 5 are studied together the operation and air passage reduction function of the fan 80 and motor contained in air turbine hub 82 will become apparent. In FIG. 3 there is shown fitted in branch air supply duct 18*a* the fan 80 and its hub 82 which contains a motor and which may be secured to the duct 18*a* by conventional means not shown. Secured to the turbine hub 82 are fan impeller blades. Only two (2) fan blades 85 and 86 are shown. It is to be understood that the number of fan blades is a matter of design and may number more than two.

Figure 7:
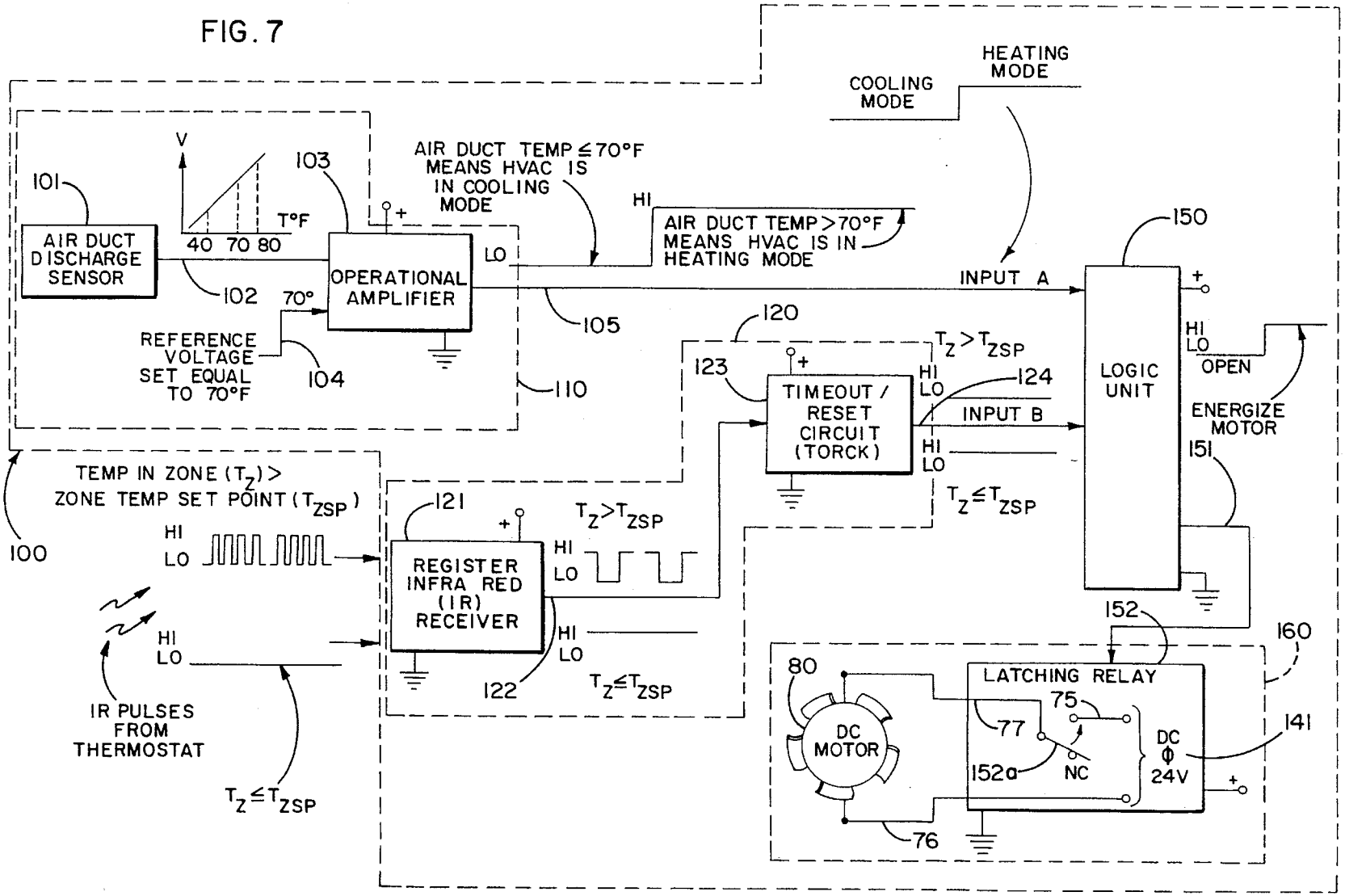
FIG. 7 is a schematic showing of the relationship of the components present in a register flow control unit embodying the opposing flow form of the invention.

Reference is now made to FIG. 4 which depicts in schematic form the basic components of a control system for an air delivery system embodying one form of the invention. On the left, as FIG. 4 is viewed, is wireless airflow control thermostat 30, which includes a conventional set temperature readout 33; manually operable temperature increase and decrease select buttons 34, 35; heating or cooling select button 36, and infra red (IR) transmitter 37. The register flow control unit 100 which is electrically powered and is electrically self-sufficient is shown schematically in FIG. 8 on the right side of the drawing. A detailed layout of the register flow control unit 100 is shown in FIG. 7 and will be described in detail hereinafter. It is sufficient to note at this point that the register flow control unit 100 includes, interconnected as shown, four (4) basic functional components, namely an HVAC temperature detection circuit or unit 110; a wireless airflow control signal detection and decoding unit or circuit 120; a logic unit 150, and an opposing flow turbine control unit 160.

Figure 6:
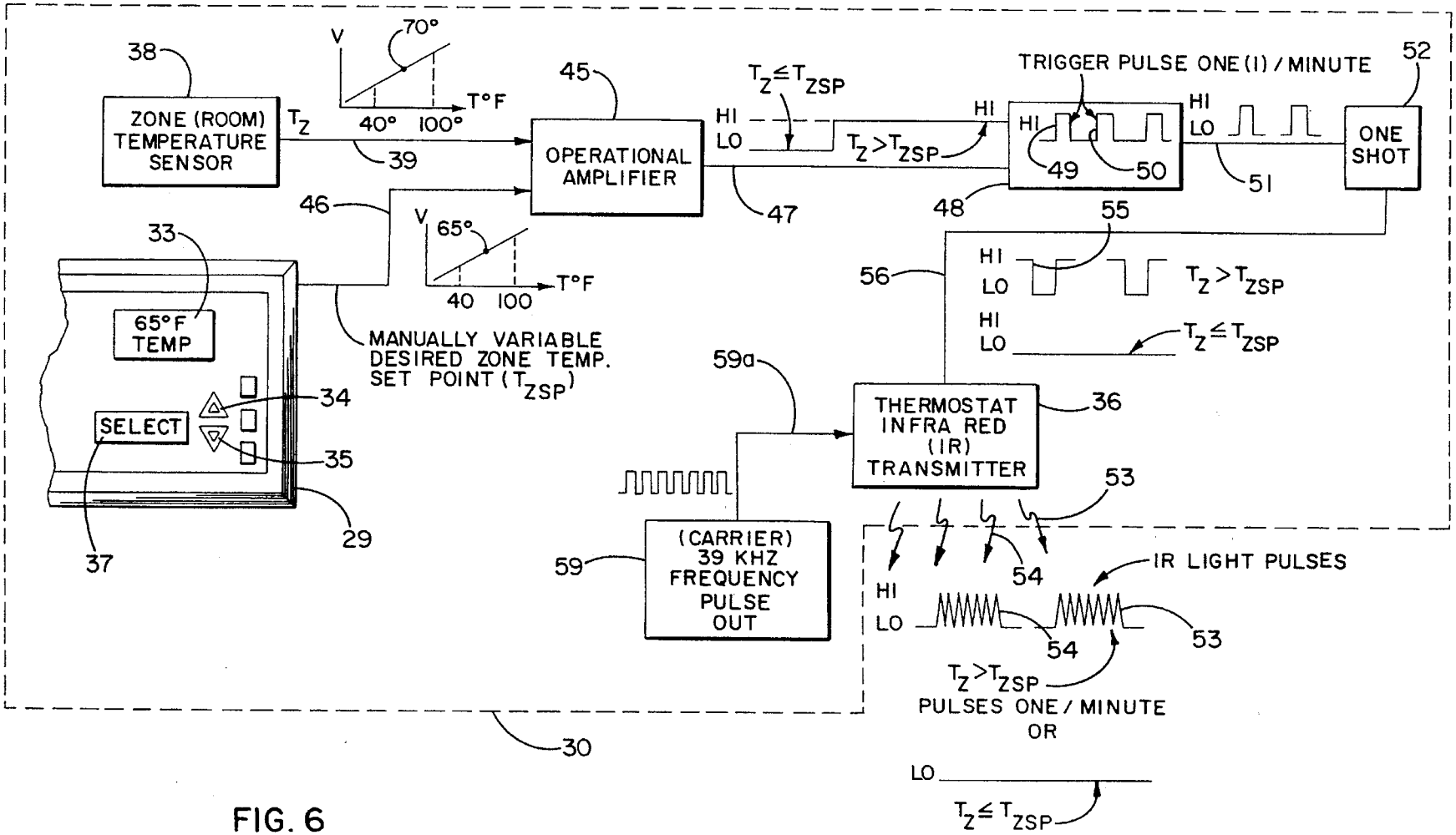
FIG. 6 is a schematic showing of the relationship of the components present in a wireless flow control thermostat employed in the invention.

Attention in now directed to FIG. 6 which illustrates in block diagram layout the details of the wireless airflow control thermostat 30 employed in zone #1 of FIG. 1.

In the left hand portion of the drawing of FIG. 6 there is shown in broken away fashion an external portion 29 of the wireless airflow control thermostat 30 described with respect to FIG. 6. Shown in broken line 29 surrounding the block diagram are the essential component parts of the wireless airflow control thermostat 30 which will now be described. The wireless thermostat 30 includes in a conventional manner a zone or room temperature sensor 38 which provides on an output lead 39 a signal representative of the rooms ambient temperature, Tz, at any given moment. The ambient temperature signal on lead 39 is delivered to an operational amplifier 45 which has an another input lead 46 which provides a manually variable, desired zone temperature setpoint (Tzsp). In the situation being described the Tzsp has been selected by the zone #1 occupant at 65 F. The operational amplifier 45 functions in a conventional manner and provides on output lead 47 a low (Lo) output whenever the ambient zone temperature Tz is less than or equal to the zone temperature setpoint Txsp (Tz<Txsp) here 65 F. and a Hi output whenever the ambient zone temperature Tz is greater than the zone temperature setpoint Tzsp (65 F.), namely Tz>Txsp. The lead 47 is connected as shown to a trigger pulse circuit 48 which responds to produce trigger pulses 49, 50 at the rate of one per minute whenever the output signal on lead 47 from the operational amplifier 45 goes Hi. The trigger pulses 49, 50 appear on lead 51 where they are delivered to a one shot circuit 52 that produces the wave form output 55 on lead 56 whenever and for as long as TZ>Tzsp. The wave form output 55 appears on lead 56 where it triggers the thermostat infra red (IR) transmitter 36 to provide the wireless IR signals 53, 54 to the register flow control unit 100 not shown in this figure. A carrier frequency source 59 of 39 KHZ modulates the IR signal output over lead 59*a* to provide the wave form 53, 54 shown below as jagged line IR signals 53, 54. It should be apparent that when the temperature in the zone Tz is less than or equal to the zone temperature setpoint Txsp ie 65 F. there will be no IR transmitter 36 output.

Attention is now directed to FIG. 7 which illustrates in a schematic block diagram form the internal workings of the register flow control unit 100 shown in broken line. At the left hand side of the drawing of FIG. 7 there is shown in broken line an HVAC temperature detection unit or circuit 110. The HVAC temperature detection circuit 110 includes two major components, namely, an air duct discharge sensor 101 electrically coupled to operational amplifier 103 via a lead 102. The sensor 101 and operational amplifier 103 are conventional in nature. The air duct discharge sensor 101 is positioned in the system so that conditioned discharge air flowing from the main supply duct 18 via duct branch 18*a* temperature is measured in order to determine whether the system is in the heating or cooling mode. The temperature of 70 F. has been selected as a reference point. Whenever the air coming from the HVAC unit 15 through ducts 18 and 18*a* is above 70 F., this condition will be considered to be a heating mode, whereas if the temperature of the air from the HVAC is below 70 F. the system will be considered to be in its cooling mode. Accordingly, the operational amplifier 103 is designed to provide a Lo output on lead 105 indicating the HVAC as operating in a heating mode. The Hi or Lo outputs on lead 105 are delivered to logic unit 15, the function of which will be described hereafter, Just beneath the HVAC temperature detection unit 110, also shown setout in broken line, is the wireless airflow control signal detection and decoding unit or circuit 120. The basic functions of the just noted unit 120 are to receive ie detect the wireless IR signals 53, 54 from the wireless airflow control thermostat 30 and decode the transmitted information from the wireless airflow control thermostat transmitter 36.

The wireless IR signals 53, 54 are received by IR receiver 121 which in turn provides a signal out on lead 122 representative of an envelop 123 of signals 53, 54. The possible output signals on lead 122 are shown for the conditions Tz>Tzsp which represents zone ambient temperature greater than zone temperature setpoint which had been arbitrarily set a 65 F. for purposes of explaining the airflow control system operation.

The just described output on lead 122 is delivered to timeout/reset circuit (TORCKT) 123 which provides an output on lead 124 to the logic unit 150. The TORCKT 123 is designed to provide a low (Lo) output on lead 124 when the IR pulses are representative of the condition Tz<Tzsp and a Hi output on lead 124 when the IR pulses are not present on the lead 122 to the TORCKT 123 for 5 minutes. When this state is present the output on lead 124 goes Hi indicating that TZ<Tzsp.

Located on the lower right hand corner of the drawing of FIG. 7 is the opposing flow, fan control unit 160 shown in broken line. Direct current is provided on leads 75, 76 from a power supply not shown. The power supply may use a conventional AC to DC converter that provides 24 volt DC over leads 75, 76 via the front relay contact 152*a* of a latching relay 152 to DC motor driven turbine 80.

The logic unit 150 has a single output on lead 151 which is electrically connected to a latching relay 152 which when energized goes from a normally closed (NC) electrical contact position to a normally open (NO) electrical contact position. When the latching relay 152 is activated an electrical circuit is completed across the DC motor driven turbine 8 and DC power supply 141 via leads 75, relay contact 152*a* lead 77 and lead 76. This results in the energizing of the DC motor driven turbine providing a flow of air that opposes the normal flow of air that opposes the normal flow of air through the register. This results in a significantly reduced airflow through the register airflow control unit 100 and the air delivery register 60 in particular.

It should be understood that the invention contemplates as included within the language of the claims solid state electronic devices in place of for example the latching relay 152.

An understanding of the full operation of the air control system of FIGS. 1 to 7 is readily discernable when the "Logic Unit" of FIG. 5 is studied in conjunction with the earlier described units and circuits.

Figures 8, 9, 10:
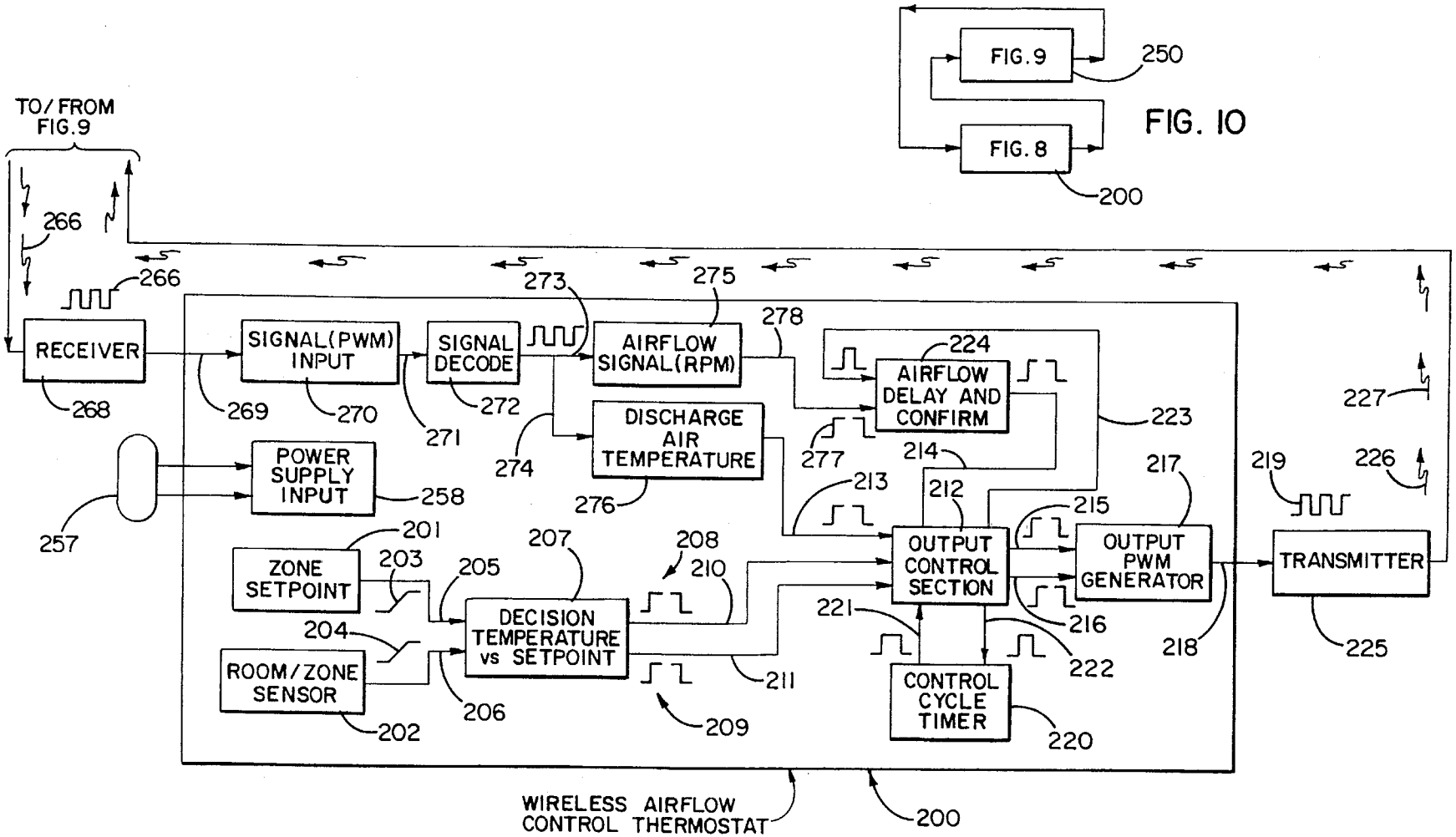
FIG. 8 is a schematic diagram of a system interface that is to be studied in conjunction with FIG. 9.
FIG. 9 is a schematic diagram of a thermostat/controller that cooperates with the interface system of FIG. 8 to provide both opposing and aiding airflow control and FIG. 10 shows diagrammatically how
Figure 9:
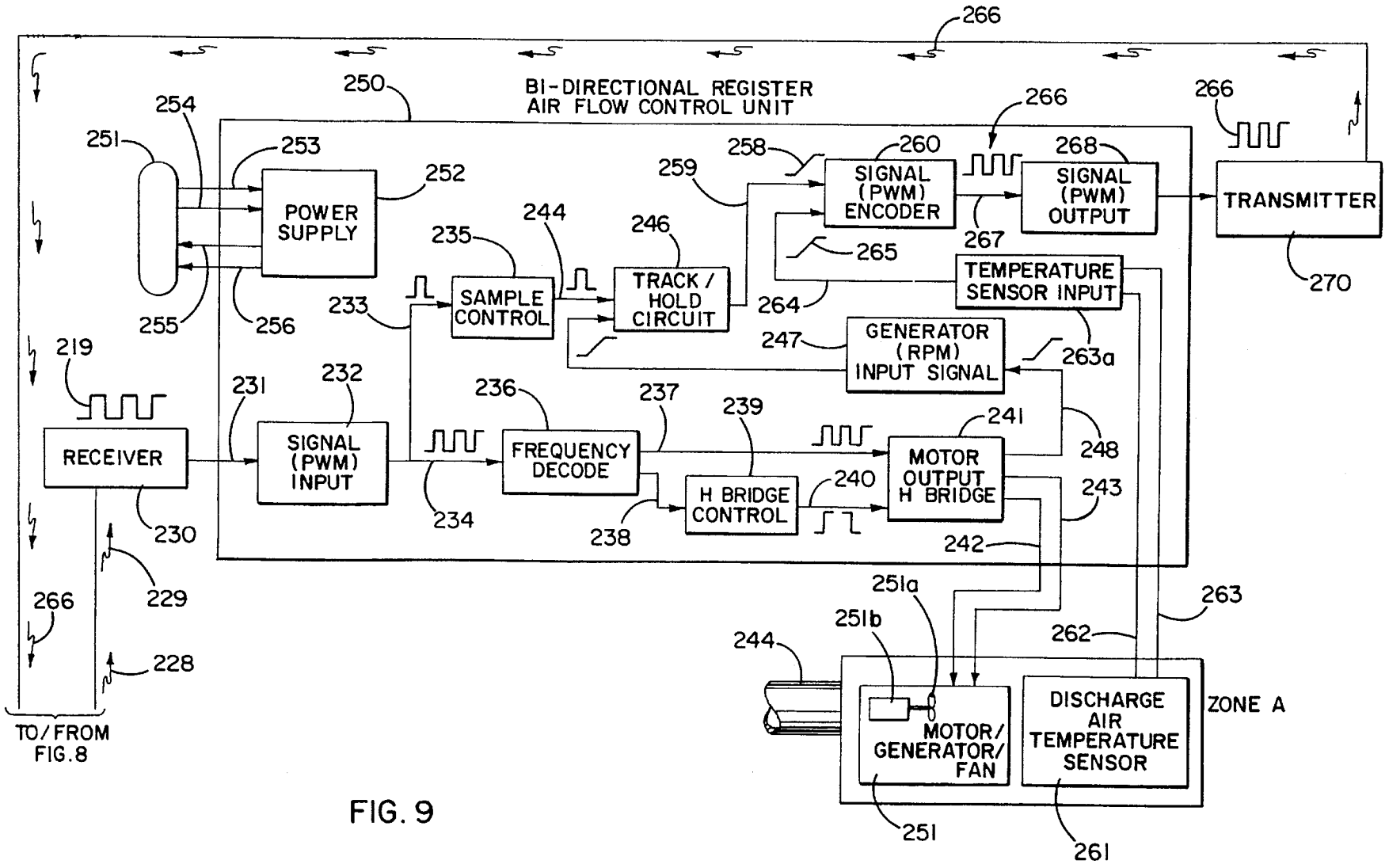

Reference is now made to FIGS. 8 and 9 which are shown taken together in diagrammatic form in FIG. 10. FIG. 8 and 9 depict a preferred embodiment of the invention of this continuation-in-part application. FIG. 8 is a block diagram of a wireless airflow control thermostat 200 employed in the practice of the invention, whereas, FIG. 9 is a block diagram of a bi-directional register airflow control unit embodying the invention.

At the outset of the description of FIGS. 8 and 9 it is to be understood that a number of the functions depicted in the block diagrams of FIGS. 8 and 9 while shown in one of the figures could just as well be performed in either of the arrangements shown in FIGS. 8 and 9.

Accordingly what is shown and described hereinafter is a preferred embodiment of the invention an understanding of which will be sufficient to make and practice the invention.

It should be further understood that all the functions performed in the boxes of a block diagram may just as well be accomplished in software. The block diagram approach has been selected as the medium through which the reader of the specification may more readily visualize the functional co-operation of the many components required to practice the invention.

An explanation of the nature of operation and co-operation of each component in the block diagrams of FIGS. 8 and 9 will be undertaken. This explanation will then be followed by a brief description of system operation which will demonstrate the nature of the invention as defined by the claims appended to the specification.

Reference is now made to FIG. 8 which depicts in block diagram format the wireless airflow control thermostat 200. The thermostat 200 is normally placed within a zone/room a temperature of which is to be controlled. As described earlier that thermostat 200 is provided with a zone set point unit 201 and a room/zone sensor 202.

The zone set point unit 201 provides a user selected target value which will be compared to the actual zone temperature to determine zone demand conditions. The room/zone temperature sensor 202 measures the actual zone temperature that is present. Analog signal outputs 203,204 representative of the outputs of the unit 201 and sensor 202 are delivered as shown over lines 205, 206 to a temperature vs. set point decision unit 207. This unit 207 uses the actual zone temperature and set point to determine the present zone demand. This demand will be utilized by the output control section unit 212 to determine if the motor/generator/fan unit 251 FIG. 9 should be operated in a "free wheel", "boost" or "restrict mode". The terms "freewheel", "boost" or "boost" or "restrict mode" have the following meanings with respect to temperature demand conditions.

Boost i.e., undersatisfied—This condition exists when a room or zone temperature versus setpoint is undersatisfied based upon the present discharge air conditions. Undersatisfied is defined as too cool during discharge of air that should be providing heat and too warm during discharge of air that should be cool. These conditions cause the bi-directional register air flow control unit 250 to request a boost mode which provides additional airflow until the zone setpoint is reached.

Restrict i.e., oversatisfied—This condition exists when the room or zone temperature versus setpoint is oversatisfied based upon the present discharge of air that is providing heat and too cool during discharge of air that is providing cooling. These conditions cause the bi-directional register airflow control unit 250 to request a restrict mode which decreases airflow until the zone setpoint is reached.

Free wheel i.e., satisfied—This condition exists when the room or zone temperature versus setpoint is within a targeted range. Neither booster restrict mode is required. Zone demand indicate that the overall zone satisfaction and requirements to return the zone to a satisfied condition. The temperature vs. setpoint decisions are represented as being present by ON/OFF signals 208, 209 on lines 210, 211 which are fed directly to the output control section unit 212 next to be described before continuing with a description of the function of output control section 212. A brief commentary will be offered with respect to the motor/generator/fan unit 251. The motor/generator/fan unit 251 provides the actual means to control the actual airflow. A fan blade or turbine blade as it may be termed, is attached to this motor/generator to allow for generator output information during passive mode (free wheeling) operation and for output (motor) action during active modes i.e., boost/restrict, operation.

The output control section unit 212 receives information regarding present confirmed airflow conditions on lines 213, 214 and zone demand requests on lines 210, 211 to determine and an output signal to be delivered on lines 215, 216 to an output PWM generator 217. The function of the output PWM generator 217 will be explained more fully hereinafter. A zone demand of either undersatisfied or oversatisfied along with a confirmed airflow condition on line 214 will initiate a boost or restrict cycle. The cycle operates for 5 minutes (longer or shorter cycle times may be selected). This process will be terminated and repeated until either airflow does not exist or zone demand goes away. Control of this just referred to cycle time is provided by a control cycle timer 220. This timer is a 5 minute timer which is initiated by the output control section unit 212 via a signals on lines 221, 222. The 5 minute cycle is initiated by the output control section unit 212 whenever a boost or restrict operation cycle as started. The timer will indicate the completion of a 5 minute period and terminates output control action. This time out also resets via the output control section unit 212 and a signal on line 223, the airflow confirmation circuit 224 (to be described) whereas the process to enable an active output must proceed the process previously described.

The output PWM generator 217 generates and actual output signal 219 on line 218 based upon the output control section unit 212 request on lines 215, 216. The output signal 219 will be a PWM signal at two possible frequencies. The output signal 219 is a square wave PWM signal that can be generated at two (2) different frequencies. At one of frequencies the output signal 219 will be decoded by the bi-directional register airflow control unit 250 in a manner yet to be described. The decoded signal will cause the motor/fan 251, FIG. 9 to be driven in either direction i.e., boost or restrict.

Attention is directed to the right hand side of FIG. 8 where the PWM output signal 219 on line 218 is shown entering a wireless transmitter 225 and emerging as a wireless signal or evidenced by jagged arrows, for example arrows 226, 227, and arrows 228, 229 FIG. 9. It is to be understood that the manner of transmitting the PWM signal to the bi-directional register airflow control unit 250 is not part of the invention. Accordingly any suitable means may be utilized.

A full description of the operation of the block diagram of FIG. 8 is not yet complete. We will return to FIG. 8 after we have explored the operation of the bi-directional register airflow control unit 250. Accordingly the output PWM signal 219 from the wireless airflow control thermostat 200 is delivered via a conventional receiver 230 (FIG. 9) and a line 231 to a PWM signal input unit 232. This unit 232 receives the control request PWM signal 219 from the wireless airflow control thermostat 200. The signal 219 consists of a square wave pulse width modulated (PWM) waveform which is received at two different frequencies. The signal 219 indicates the requested output motor drive and direction as determined by the wireless airflow control thermostat 200.

The PWM signal 219 is delivered via the PWM signal input circuit 232 and lines 233,234 to a sample and control unit 235 and a frequency decode circuit 236. The frequency decode circuit 236 decodes the output control request provided by the wireless airflow control thermostat 200. The PWM signal on line 234 represents a request which is received as a 0 to 100% duty cycle (high) signal at two distinct frequencies. The 0 to 100% determines the output power (speed) applied and the individual frequency determines the direction of fan blade rotation (boost or restrict mode). The sample and control unit 235 use the received PWM signal on line 233 as a means for determining the connect time to measure the motor/generator/fan unit 251 output when in the generator mode. Note that the signal is never allowed to be set to a full 100% "ON" level as the voltage sample taken from the generator can only occur when power to the motor/generator/fan unit 251 is disabled.

Before continuing with a description of the functional interrelation of the remaining components of FIG. 9, a brief comment will be made regarding the power supply 252, shown to the left in FIG. 9, the power supply 252 is shown coupled to power connector 257 via lines 253,254, 255 and 256. The power supply 252 is an externally connected power source (i.e., 24 volt AC) and generates the necessary power levels to operate the bi-direction register airflow control unit 250, the wireless airflow control thermostat 200 and the motor/generator/fan unit 251 for bi-directional operation. In FIG. 8 it will be observed that a power connector 257' is coupled by lines unreferenced to an input power supply 258. The input power supplies 252, 258 are both connected by means not shown to the respective units or circuits of the block diagram illustrations of FIG. 8 and FIG. 9.

Attention is now redirected to the frequency decode circuit 236 of FIG. 9 and it outputs on lines 237, 238. The decoded signal of the frequency decode circuit output on line 238 is delivered to an H bridge control circuit 239. This circuit 239 monitors the frequency requested and acts to control a motor output H bridge 241 (to be described) to set a desired direction of blade rotation. In this preferred embodiment a 12.5 HZ frequency signal operates the motor of the motor/generator/fan unit 251 in a restrict mode, whereas a 25.0 HZ signal operates the same motor in a boost made. An output from the H bridge control circuit 234 is delivered over line 240 to the motor output H bridge 241. The motor output H bridge circuit 241 provides an actual output connection via lines 242, 243 to the motor/generator/fan unit 251. The speed and direction of the fan is determined by the decoded PWM signal on line 237 to the H bridge 241. An output signal on lines 242, 243 provides a signal that will drive the motor in a direction which is dictated by the output polarity of the motor output bridge 241.

The description that now follows will involve the functional cooperation of a track/hold section circuit 246, and a generator (RPM) input signal circuit 247 of FIG. 9.

The motor output H bridge signal delivered over line 248 is an analog signal proportional to motor/generator RPM and hence directly related to the cubic feet per minute (CFM) of airflow through an air supply duct 244. More specifically the generator (RPM) input signal circuit 247 performs a required conditioning of the generator voltage before the voltage is applied to the track and hold circuit 246 via line 245.

The track and hold circuit 246 performs a track and hold function on the generator output voltage from generator 251. The track and hold circuit 246 will continuously measure the generator voltage as allowed by the sample control circuit 235. Generator voltage will be measured whenever power is not applied to the motor/generator/fan 251, thus the track function of the circuit. This voltage value will be captured and held whenever power is applied to the motor/generator/fan 251, thus the hold function. The analog voltage output signal 258 on line 259 is very important as it indicates the speed and direction of the motor/generator/fan.

The analog voltage output signal 58 is applied as shown to a PWM signal encoder 260. The PWM signal encoder 260 simultaneously receives the analog voltage output signal 258, just mentioned, as well as, an analog discharge air temperature signal 265. This discharge air temperature sensor 261 (shown lower right FIG. 9) provides data to determine whether the entire system is in a heating or cooling mode. Lines 262, 263 carry on them an input signal representative of discharge air temperature. The discharge air temperature sensor 261 measures the actual discharge temperature. The sensor 261 is strategically placed in a location and provides continuous accurate measurement of the discharge air. A temperature sensor signal conditioning circuit 263*a* receives the signals on lines 262, 263, and conditions the signal prior to input as the analog discharge air temperature signal 265 to the PWM signal encoder circuit 260. The encoder 260 encodes both the present generator voltage value and discharge air temperature value to generate a PWM signal. The PWM signal 266 consists of a square wave 253 HZ pulse width modulated PWM signal. Multiple pieces of information have been encoded by the bi-directional register air flow control unit 250 to be decoded by the wireless airflow control thermostat 200 (FIG. 8). This information includes: discharge air (heat/cool), generator speed (RPM) and direction. A 0 to 100% duty cycle (high) has been segmented into two distinct ranges. A 0 to 45% range indicates discharge air is cool and a 55% to 100% range indicates discharge air is warm. The value within each segment provides the generator speed (RPM) and direction where a center of 22.5% and 77.5% is considered to be zero (0) RPM or no generator movement. The encoded PWM signal 266 is delivered via line 267 to what is termed a PWM signal output 268 which in turn delivers this PWM signal 266 via line 269 to a transmitter 270.

Attention is now directed to FIG. 8 and the upper left hand corner thereof where it will be observed that PWM signal 266 from the transmitter 270 (FIG. 9) is delivered to a receiver 268 which in turn delivers the PWM signal to a PWM signal input circuit 270 via line 269. The PWM signal is received over line 271 by a signal decoding circuit 272. A PWM decoded signal is delivered via lines 273,274 airflow RPM signal circuit 275 and discharge air temperature circuit 276. An output signal 277 on line 278 is delivered to an airflow delay and confirm circuit 224. The delay and confirm circuit 224 performs a confirmation of airflow whenever the RPM signal has exceeded a threshold indicating the presence of airflow. The signal must be present and consistent throughout this airflow confirmation process. This prevents any actual output control when no airflow is present.

From the foregoing description of the bi-directional airflow controllable system of FIGS. 8 and 9 it will be readily appreciated that the system controls the flow of air through the system to at least one zone (FIG. 9*a*) an air system includes in FIG. 9*a* temperature of which is to be controlled. The bi-directional register airflow control unit 250 which is coupled to an airflow duct 244 to aid or oppose airflow throughout the duct and system to the zone. The airflow control system includes a fan 251*a* positioned to interact with air moving through the system and the duct 244. The fan 251*a* is coupled, as shown, to a motor/generator 251*b* to be energized to drive the fan in a forward or reverse direction. The fan 251*a* when driven by the energized motor in a forward direction creates air pressure from the fan to oppose the flow of air from the airflow duct 244. The fan 251*a* when driven by the energized motor 251*b* in a reverse direction aids the flow of air from the airflow duct 244. The bi-directional register airflow control unit 251 is electrically coupled via lines 242, 243 to the motor 251*b*. The bi-directional register airflow control unit is responsive to a desired temperature in zone A (see zone sensor 202, FIG. 8) to cause the motor 251*b* to be energized in a forward direction to oppose flow through the system until a desired zone temperature is attained. The bi-directional register airflow control unit 251 is additionally responsive to the desired temperature in the zone to cause the motor to be energized in a reverse direction to aid the airflow through the system until the desired zone temperature is reached.

In accordance with the primary objective of the invention to provide a method and apparatus for controlling airflow in a given direction in an air circulating system, it follows that while in the preferred embodiment of the invention the powered flow control unit is shown in a register, the powered flow control unit maybe positioned anywhere in the system to provide an airflow damping function in accordance with the invention.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What I claim as new:

1. A bi-directional airflow controllable system for controlling flow of air through an air circulating system to at least one zone an air temperature of which is to be controlled, said bi-directional air flow controllable system comprising:

a bi-directional fan control means to power a motor driven fan in one direction to oppose air flow when more air is being provided than is needed to control air temperature in said zone, said bi-directional fan control means providing power to said motor driven fan in an opposite direction to reverse fan rotation and thereby aid the flow of air when more air is needed to control temperature in said zone than is being provided.

2. A bi-directional air flow controllable system for controlling flow of air through the system to at least one zone an air temperature of which is to be controlled, said bi-directional airflow system is coupled to an airflow duct to aid or oppose air flow throughout said duct and said system to said zone, said bi-directional air flow controllable system comprising:

a fan positioned to interact with air moving through said system and said duct, said fan coupled to a motor to be energized to drive the fan in a forward or reverse direction, said fan when driven by said energized motor in a forward direction creates air pressure from the fan to oppose the flow of air from the airflow duct, said fan when driven by said energized motor in a reverse direction aids the flow of air from the air flow duct, a bi-directional air flow control means electrically coupled to said motor, said bi-directional air flow control means is responsive to a desired temperature in said zone to cause said motor to be energized in a forward direction to oppose flow through said system until said desired zone temperature is attained, said control means additionally responsive to said desired temperature in said zone to cause said motor to be energized in a reverse direction to aid the air flow through said system until said desired zone temperature is attained.

3. A method for bi-directional air flow control in an air circulating system that provides air flow in a given direction, comprising the steps of:

a) placing a motor driven fan in said air circulating system in such a manner that said fan when driven by the motor in one direction creates pressure in a direction opposing said given direction of air flow; said fan when driven by the motor in an opposite direction reduces pressure in a direction which aids air flow in said given direction of air flow, b) activating said motor to drive said fan in said one direction to cause said air flow moving in said given direction to be diminished because of said opposing pressure, and c) activating said motor to drive said fan in said opposite direction to cause said air flow moving in said given direction to be aided because of said reduced pressure.

* * * * *